United States Patent [19]

Eddy et al.

[11] 4,065,586

[45] Dec. 27, 1977

[54] FIXING METHOD USING POLYARYLSILOXANES AS RELEASE AGENTS

[75] Inventors: Clifford O. Eddy; Thomas R. Hoffend, both of Webster, N.Y.

[73] Assignee: Xerox Corporation, Stamford, Conn.

[21] Appl. No.: 662,658

[22] Filed: Mar. 1, 1976

[51] Int. Cl.[2] ..... G03G 13/20

[52] U.S. Cl. ..... 427/22; 118/60; 148/6.14 R; 427/194; 432/60

[58] Field of Search ..... 427/22, 194; 118/60; 432/60; 29/132; 260/448.2 R; 148/6.14 R

[56] References Cited

U.S. PATENT DOCUMENTS 3,937,637 2/1976 Moser et al. ..... 427/22 X

OTHER PUBLICATIONS

Willis and Shaw, *Journal of Colloid and Interface Science,* vol. 31, No. 3, Nov. 1969, pp. 397–408.

*Product Licensing Index,* July 1972, pp. 72–73.

*Primary Examiner*—Harry J. Gwinnell

*Assistant Examiner*—Stuart D. Frenkel

*Attorney, Agent, or Firm*—James J. Ralabate; Ernest F. Chapman

[57] ABSTRACT

Polyarylsiloxanes are used on fusing devices in photocopiers to fix particulate thermoplastic toner to a substrate while the toner is in a fused state. The polyarylsiloxanes can be continuously applied in minimal thicknesses on the fusing device to form a thermally stable, renewable, self-cleaning layer having excellent toner release properties. A preferred polyarylsiloxane is polyphenylmethyl dimethyl siloxane.

20 Claims, 2 Drawing Figures

FIXING METHOD USING POLYARYLSILOXANES AS RELEASE AGENTS

BACKGROUND OF THE DISCLOSURE

This invention relates generally to xerographic copying methods and apparatus, and more particularly, it relates to the fixing of particulate thermoplastic toner by direct contact with the surface of a fusing member having a novel fluid release surface.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitve member or transferred from the member to another support, such as a sheet of plain paper, with subsequent affixing of the image thereto.

In order to affix or fuse electroscopic toner material onto a support member permanently by heat, it is necessary to elevate the temperature of the toner material to a point at which the constituents of the toner material coalesce and become tacky. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy for fixing toner images onto a support member is old and well known.

One approach to thermal fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll thereby to affect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner at which temperature the toner particles in the image areas of the toner liquify and cause a splitting action in the molten toner resulting in "hot offset". Splitting occurs when the cohesive forces holding the viscous toner mass together are less than the adhesive forces tending to offset it to a contacting surface such as a fuser roll.

Occasionally, however, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them. In such a case, toner particles may be transferred to the surface of the fuser roll with subsequent transfer to the backup roll during periods of a time when no copy paper is in the nip.

Moreover, toner particles can be picked up by the fuser and/or backup roll during fusing of duplex copies or simply from the surroundings of the reproducing apparatus.

One arrangement for minimizing the foregoing problems, particularly that which is commonly referred to as "offsetting", has been to provide a fuser roll with an outer surface or covering of polytetrafluoroethylene, known by the trade name "Teflon" to which a release agent such as silicone oil is applied, the thickness of the Teflon being on the order of several mils and the thickness of the oil being less than 1 micron. Silicone oil, polydimethylsiloxane, which possesses a relatively low surface energy, has been found to be a material that is suitable for use in the heated fuser roll environment where Teflon constitutes the outer surface of the fuser roll. In practice, a thin layer of silicone oil is applied to the surface of the heated roll to form an interface between the roll surface and the toner images carried on the support material. Thus, a low surface energy layer is presented to the toner as it passes through the fuser nip and thereby prevents toner from offsetting to the fuser roll surface.

A fuser roll construction of the type described above is fabricated by applying in any suitable manner a solid layer of abhesive material to a rigid core or substrate, such as the solid Teflon outer surface or covering of the aforementioned arrangement. The resulting roll structure is subject to wear and degradation due to continued operation at elevated temperatures and also to damage from accidental gouging by stripper fingers conventionally employed in such systems. The foregoing, in many instances, necessitates replacement of the fuser roll which is quite costly when a large number of machines is involved.

Moreover, the polytetrafluoroethylene along with the coating of silicone oil is of sufficient thickness to constitute a poor thermal conductor, and longer nip dwell and higher fuser roll temperatures are required to deliver the fusing energy required to fix toner. Also, control of the surface temperature of the roll presents a problem due to large temperature variations occurring before and after contacting of the substrate carrying the images.

Silicone elastomers have also been used on the surface of fuser members for fixing thermoplastic toners on receptor surfaces. In U.S. Pat. No. 3,669,707 issued June 13, 1972, silicone elastomers containing fluorinated organic polymer fillers of specified surface energy are used on the surface of fuser members for fixing toner materials. However, the coating is of sufficient thickness to constitute a poor thermal conductor, and longer nip dwell and higher fuse roll temperatures are required as in the case described above. Furthermore, the silicone gum filler is, of necessity, a dual component system to prevent hot offset. This in turn leads to additional preparation and handling problems.

In view of the foregoing it would appear that the high thermal conductivity and wear resistance of bare metals or similar materials would be desirable for utilization in fuser member structures and certain materials have been found which are satisfactory for such application. Commonly used release agents such as pure silicone oils and mineral oils, have been tried in combination with various metals and other high surface energy materials but with relatively little or no success. However, certain materials have been found which are satisfactory for such application. These materials, fusing methods and devices are described in Assignee's co-pending patent application Ser. No. 383,231 filed July 27, 1973, now U.S. Pat. No. 3,937,637 which includes providing a coating of a polymer release material of the type which oxidizes and thereafter is capable of reacting with the fuser surface material to form a first barrier coating portion upon the fuser member and a second replenishing release portion thereon. In Assignee's copending application Ser. No. 419,415 filed July 24, 1974, a coating of polymeric fluid containing built-in functional groups which interact with the fuser member surface to provide an interfacial barrier layer and a low surface energy film of the fluid, is provided upon a fuser member. Exemplary of the built-in functional groups in the foregoing reference are carboxy, hydroxy, epoxy, amino, isocyanate, thioether and mercapto. Polyalkylsiloxane fluids have also been successfully used on bare metal fuser members as described and claimed in a copending patent application assigned to the same assignee and filed herewith.

OBJECTS OF THE INVENTION

It is the principal object of this invention to provide a new and improved fusing process and device for use in fixing toner images.

Another object of this invention is to provide, for use in a photocopying apparatus and process, a fusing process, device and release agent wherein the fuser member has a continuously renewable surface.

Another object of this invention is to provide a fusing process and device wherein toner is displaced from the exposed surface of the fuser member by the action of a release agent on the surface of the fuser member, the release agent having a polysiloxane backbone with aryl or substituted aryl groups thereon.

Still another object of this invention is to provide a fusing process, device and release agent wherein an interfacial barrier is formed intermediate the fuser member surface and the fluid release layer applied thereto.

Another object of this invention is to provide a fusing device and process for toner images wherein a barrier is formed during operation of the fuser at the interface of the fuser roll surface and a release agent through interaction between the fluid release agent and the fuser roll material.

Still another object of this invention is to provide a new and improved release agent, device and method for fusing toner images to a substrate wherein toner barrier and toner release coatings are formed on a thermally conductive core and wherein the combined thickness of the coatings is insufficient to establish an appreciable thermal barrier to the energy being conducted through the core, thereby lowering the power requirements for maintaining a heated core and for the overall fusing operation.

Other objects and advantages of the present invention will become apparent when read in conjunction with the accompanying drawings and specification.

SUMMARY OF THE INVENTION

The above-cited objects of the present invention are accomplished by applying polyarylsiloxane (polydimethylsiloxane polymers having methyl groups replaced by aryl or substituted aryl groups) to a heated fuser member in an electrostatic reproducing apparatus. The aryl groups of the polyarylsiloxane, said aryl groups or substituted aryl aryl groups being attached to the silicon atoms, must comprise at least about 0.5 aryl group or at least about 0.5 substituted aryl group per polymer molecule capable of interaction with the fuser member surface and thereby provide a thermally stable interfacial barrier to the toner. The polysiloxane may also comprise a mixture of aryl and substituted aryl groups.

The polyarylsiloxane is applied in an amount sufficient to cover the surface of the fuser member with at least a continuous, low surface energy film of polyarylsiloxane to provide the fuser member with a surface which releases toner heated by the fuser member and prevents said toner from contacting the surface of the fuser member. The polyarylsiloxane must be capable of interacting with the fuser member surface to form a thermally-stable barrier to toner, said barrier designated herein as an interfacial layer, which strongly adheres to the metal, glass or other substrate of the fuser member and provides a thin coating which has excellent release properties for the toners used in electrostatic printing. The polysiloxanes containing substituent aryl and/or haloaryl groups are preferred for the method and device of the present invention and include phenyl and chlorophenyl groups.

The polyarylsiloxanes may be applied to the surface of the fuser member in thicknesses ranging from submicron to several microns to constitute a minimal barrier to heat transfer. By employing the polyarylsiloxane fluid release agent and process of this invention there is provided a fuser member having a surface surrounded only by a minute layer of material which prevents toner from contacting the surface.

While the mechanism is not completely understood, it is believed that when this class of polyarylsiloxane fluids having at least about 0.5 aryl or substituted aryl group per polymer molecule are applied to the surface of a fuser device, there is an interaction (a chemical or physical reaction, e.g., chemisorption, hydrogen bonding or other mechanism) between the metal or glass surface of the fuser member and the polyarylsiloxane, so that an interfacial barrier layer comprising the interaction product between the metal, glass or other material of the fuser members and the aryl groups of the polyarylsiloxane forms a barrier layer intermediate the metal or glass or other substrate of the fuser member and the outer layer of polyarylsiloxane coating the fuser member. This outer layer may be referred to as the nonreacted release layer, or generally, the release layer. The coating, however formed, has been observed to have a greater affinity for the fuser substrate material than the toner and thereby prevents electroscopic toners from contacting the core, while the release coating provides a material, the cohesive force of which is less than the adhesive forces between the heated toner and the substrate to which it is applied, and the cohesive forces of the toner. Not only do these coatings or films have excellent release properties, but it has also been observed that the thermally-stable layer is continuously renewable and self-repairing. That is to say, if this coating is damaged, for example, by uneven pressures exerted by the blade utilized for metering the release material to the core, or by undue forces exerted by the finger employed for stripping the substrate from the fuser roll structure, the thermally-stable coating will repair itself.

The foregoing ability of this class of polyarylsiloxanes to form a thermally stable, renewable, self-cleaning layer or layers having excellent toner release properties is surprising in view of the prior art disclosures which affirm the stability of these compounds. In a report by Willis and Shaw in *Journal of Colloid and Interface Sci-*

*ence,* Vol. 31, No. 3, November 1969, pp. 397–408, directed to the thermal oxidative decomposition of polyorganosiloxane fluids at metal surfaces, it is reported that the thermal oxidative stability of the polyorganosiloxane fluids is dependent on the nature of the substituent organic radicals, and that in this respect, the methyl- and, to a somewhat greater extent, the phenyl-derivatives are particularly stable.

However, in accordance with this invention, toner of the type commonly used in electrostatic printing is displaced from damaged or worn areas which interrupt the coatings on the heated fuser member when polyarylsiloxanes as above described, are used as release agents or materials on fuser members. The softened or tacky toner is substantially removed by the polyarylsiloxane, and the interrupted, damaged or worn area is repaired by newly metered or applied polyarylsiloxane without entrainment of excessive levels of toner which would ordinarily print out or transfer to successive substrates. This mechanism has substantially reduced offset problems common to the devices and processes of the prior art.

Generally, the polysiloxanes having aryl or aryl substituted groups are applied to fuser members as fluids and by using the term "fluid" in describing the coating materials or release fluids of this invention is meant the state which the polyarylsiloxane material assumes at operating temperatures.

By use of the phrase "capable of displacing electroscopic toner" as used herein, is meant that the polyarylsiloxane fluid substantially prevents the toner from contacting the surface of the fuser member and is more reactive than the toner with the material of the fuser member surface to the extent that it repels or displaces the toner from the surface of the fuser member even when the surface thereof is exposed to or contacts the toner.

DESCRIPTION OF THE PREFERRED EMBODIMENTS

Figure 1:
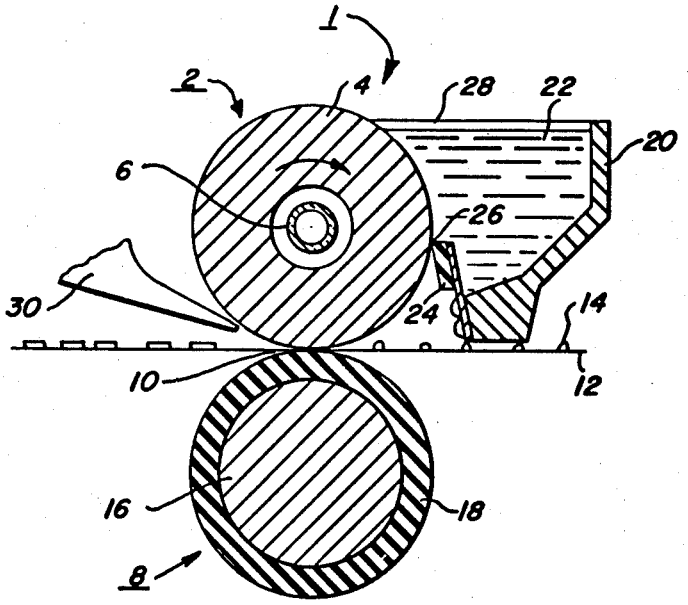
FIG. 1 is a side elevational view of a typical fuser system for a xerographic reproducing apparatus.

The polysiloxanes capable of releasing electroscopic toners are operable in accordance with the present invention only when the appropriate aryl or substituted aryl group or groups or combinations thereof are present on the backbone of the polysiloxane and substituted on the silicon atoms. The polyarylsiloxanes preferably form an interfacial barrier between the metal, glass or other material of the fuser member and the outer fluid layer of the same release material. In accordance with the present invention, this characteristic is found in polyarylsiloxane fluids which have at least about 0.5 aryl or substituted aryl groups per polymer molecule.

The specific polyarylsiloxane fluids of the present invention have a polymeric backbone of the general formula:

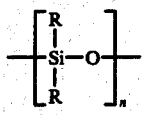

where $n$ is an appropriate number such that the polymeric material assumes a fluid state (liquid) at operating temperatures which are generally from about 200° F (93° C) to about 450° F (232° C); where at least one R in the molecule is an aryl group or a substituted aryl group and the remaining R constituents are alkyl having one or more carbon atoms and mixtures thereof and preferably methyl groups. More than one R in the molecule may be aryl groups, substituted aryl groups or combinations thereof. For example, one R in the molecule may be a phenyl group and the remaining R groups may be methyl groups, or for example, in another embodiment one R in the molecule may be a phenyl group and the other R may be a chlorophenyl group. Thus, all R's in the molecule may be the same, or they may be mixtures of aryl groups and substituted aryl groups. Furthermore, the R's may also comprise other substituents, for example, alkyl groups and halogenated alkyls and the like, and even substituted nonreactive inorganic substituents substituted on the silicon atom as long as there is the critical aryl or substituted aryl, said aryl being capable of interacting with the material of the fuser member surface to provide a thermally stable interfacial barrier layer to electroscopic toner.

A preferred class of polyarylsiloxanes useful as release agents in accordance with the present invention are the polymethylphenyl dimethyl siloxanes, the molecular structure of which may be designated as:

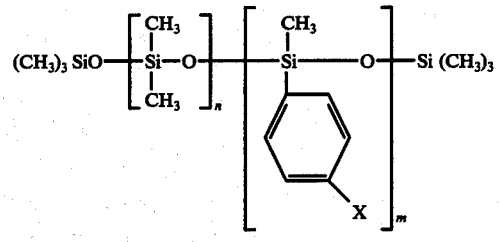

where $m$ is at least 1, $n$ is at least 1 and X is halogen or hydrogen. A particularly useful polyphenylsiloxane fluid is polyphenylmethylsiloxane where $m=0.5$–$1.0$, $n=6$–$8$, and X is hydrogen. Where $m$=less than 1.0, then all siloxane molecules do not have the structure represented within the brackets designated "$m$". Generally, those polyphenylsiloxanes with chain length where $m+n$ is equal to less than about 20 are liquid at room temperature, and are useful in accordance with the present invention, however, as explained supra, as long as the polysiloxane is fluid or liquid at operating temperatures, it is useful herein. Where the alkyl substitution on the silicon atom comprises 2 or more carbon atoms and combinations thereof and/or other non-reactive substituted groups the fluid nature of the polymer is dependent upon such substitution, and appropriate polyarylsiloxanes for use as release agents on fuser members can be chosen according to the fluid state of the polysiloxane at operating temperatures.

Representative examples of aryl and substituted aryl groups in the polyarylsiloxanes of the present invention, are phenyl, biphenyl, chlorophenyl, dichlorophenyl, trichlorophenyl, mono-, di-, and tri-nitro phenyl, bromophenyl, iodophenyl, naththyl, anthranyl, chloronaphthyl, pyrenyl and the like and combinations thereof. As indicated supra, preferred polyarylsiloxane release materials have at least about 0.5 aryl groups, substituted aryl groups or a combination of said groups per siloxane molecule. For example, in the preceding molecular structure for a polyphenylmethyl dimethyl siloxane, the molecular structure comprises at least about 0.5 phenyl groups, substituted groups or combinations thereof. Alternatively stated, this preferred class of polyarylsiloxane release materials are the polyarylmethyl dimethyl siloxanes having at least about 0.5 methyl groups per single polymer chain to at least about 1.0 methyl group per two polymer chains substituted by an aryl or aryl substituted group. The only limitation is that the polyarylsiloxane be fluid at operating temperatures and capable of interacting with the fuser member surface at least at such operating temperatures. As used herein, polyarylsiloxane or aryl polysiloxane are used interchangeably and include all of the substituted forms suggested above.

It is to be considered within the purview of one skilled in the art of manufacturing polyarylsiloxanes to provide the release fluids of the present invention. For example, methods of making such fluids are described by Kirk-Othmer "*Encyclopedia of Chemical Technology*", Interscience Publishers, volume 18, p.p. 237–241 (1969) where it is suggested that phenyl substituents are added as $[Ph_2SiO]_n$ or $[MePhSiO]_n$.

In order to provide suitable release of toner when bare fuser rolls are used in the process and device of the present invention, the polyarylsiloxane release agents preferably have the following properties either before, during or after application to the fuser member surface. The polyarylsiloxane release agents are preferably non-volatile, that is, they do not produce excessive levels of volatile fumes and vapors which penetrate the surrounding atmosphere and thereby cause deposits upon surrounding parts in the copying apparatus or fumes which are toxic, in the environment. The release material upon the fuser member should be thermally stable, that is the fluid must not form a gel or decompose at operating temperatures over reasonable periods of time, for example, at least about 200 hours at operating temperature. This is dependent upon the particular machine and machine use. The fluid is preferably noncorrosive to the machine parts and to the paper, and nonreactive, that is, inert, to the toner used in the development of the electrostatic latent image. During operation the polyarylsiloxane fluid must present a low energy surface to the toner which is undergoing fusing by heat, that is, it must be abhesive, and the surface energy must be less than the surface energy of the molten or heated toner. For example, a conventional toner has a room temperature surface energy of about 28–36 dynes/cm, and the fluid must have a surface energy less than that of the toner. The interfacial layer is preferably impenetrable to the toner, that is, electroscopic toner applied to the fuser member and softened should not be able to penetrate the intact interfacial barrier layer so that the fuser member surface will be exposed to toner particles which may become entrapped within the layers upon the member. The fluids must be capable of application to the fuser member in minute thicknesses preferably of the order of magnitude of 10 microns or less so that only a minimum thermal barrier will be coated upon the bare fuser member. It is also preferred that any interfacial layer which forms a barrier between the fuser member surface and the outer release layer remain insoluble in the non-volatile fluid release layer even at the operating temperatures of the device.

Generally, the modes in which the release agents of the present invention are utilized are those wherein the coating can be continuously applied to the surface of the fuser member, and accordingly, the coating is deemed self-renewing in these cases. The polyarylsiloxane may be applied to the fuser member by any of the standard or conventional methods or devices known to those skilled in the art, and includes application by brushes, by spraying, by metering from a sump, by application from a wiper blade or wiper comprising the polyarylsiloxane, by applying from a suitable sump, by applying from a wick, by padding, and the like. In general, one skilled in the art will be able to use this invention in the fuser assembly of a copying device wherein thermoplastic resin toner applied to a substrate in image configration must be heated or fused in order to fix permanently the colored substance in image configuration upon the substrate. The polyarylsiloxane release material may also be applied in the form of a solid which becomes fluid at operating temperatures, for example, a block of the polymer or elastomer may rub against the heated fuser member to apply a fluid film on the fuser member. The release agent may also be applied in conjunction with a cutting or dilution agent with which it is miscible, that is, as two or more miscible components as described in a copending patent application assigned to the same assignee as the instant patent application and filed herewith. For example, the polyarylsiloxane fluids may be mixed with polydimethylsiloxane to provide effective release. Effective release is generally provided when there are at least about 0.5 aryl or substituted aryl groups per molecule. The release agents of the present invention may also be applied as a single component to provide both the interfacial barrier and the release surface.

In applying the polyarylsiloxane fluid to the surface of the fuser member, the fluid which is capable of interacting with the fuser member surface to form a thermally stable interfacial barrier to the toner, must be applied in an amount sufficient to cover the surface with at least a continuous low surface energy film in order to provide the fuser member with a surface which not only releases toner heated by the fuser member but also with an amount which will prevent the toner from contacting the surface of the fuser member. Generally, in accordance with the objects of the present invention, the amount sufficient to cover the surface must be that amount which will maintain a thickness of the fluid in a range of submicron to microns and is preferably from about 0.5 micron to about 10 microns in thickness, and more preferably from about 1 to about 4 microns. Thus, in essence, the layer of the polyarylsiloxane fluid on the surface of the fuser member is so slight that there is essentially a bare fuser member. Although this layer or coating of the polyarylsiloxane fluid may be applied to the fuser member surface intermittently, it is generally preferred to apply the fluid continuously on the heated fuser member to maintain thereon a coating of the fluid and the interaction product or products formed by interaction with the material of the fuser member. During operation of any automatic electrostatic reproducing apparatus, it is generally preferred to apply continuously the fluid on the heated fuser member in order to replace the fluid which is retained by the substrate when the substrate is the type which absorbs the fluid or to which the fluid may adhere, generally in an amount which is measured in fractions of a microliter for each copy. However, in embodiments where there is little or no loss of the fluid from the surface of the fuser member, continuous application of the fluid may not be necessary, and it may be preferred to utilize application techniques which only apply fluid intermittently to the surface.

In general, the method of the present invention applies to fusing electroscopic toner images to a substrate and includes the steps of forming a coating or layer on a heated fuser member of an electrostatic reproducing apparatus, said coating being a barrier to the electroscopic toner and comprising the product resulting from the interaction of the fuser member and polyarylsiloxane fluid, said polyarylsiloxane being fluid at the temperatures of the fuser member and acting as a release coating for the electroscopic toner. The toner image on the substrate, e.g., paper, polymeric sheets, metals, and the like, is contacted with the heated fuser member for a period of time sufficient to soften the electroscopic toner, and then the softened toner is allowed to cool. The toner barrier coating and the fluid toner release coating are preferably on the order of about 0.5 micron in thickness. The thickness of the barrier coating and release layer is limited only to the extent that such barrier coating and release layer do not substantially prevent heat transfer from the inner core of the fuser member to the toner undergoing fusing upon a substrate, and to the extent that there is a sufficient film of the release material on the surface of the fuser member to prevent hot offsetting on the heated fuser member, that is, to prevent the retention of the tackified or molten toner by the surface of the heated fuser member so that the retained toner will not transfer to the next substrate containing the heated fuser member.

The electroscopic toners that form the toner images, for example, numeral 14 in FIG. 1, are preferably comprised of a thermoplastic resin in addition to colorant such as dyes and/or pigments. Examples of conventional pigments are carbon black and furnace black. The developer material may also contain cleaning materials, plasticizers, and other additives in accordance with the desired formulation. Typical toners may be chosen by one skilled in the art and also include thermosetting resins and other conventional heat fusible materials comprising resinous components. For example, a copolymerized mixture of styrene or a blend of styrene monologs with 10–40 percent (by weight) of one or more methacrylate esters selected from the group consisting of ethyl, propyl and butyl methacrylates as described in U.S. Pat. No. 3,709,342 may be used, said reference being incorporated herein by reference. Typical toner materials include gum copal, gum sandarac, rosin, asphaltum, pilsonite, phenol formaldehyde resins, rosin-modified phenol formaldehyde resins, methacrylic resins, polystyrene resins, polypropylene resins, epoxy resins, polyethylene resins and mixtures thereof. Among other patents describing the electroscopic toner compositions are U.S. Pat. No. 2,659,670 to Copley; U.S. Pat. No. 2,754,408 to Landrigan; U.S. Pat. No. 3,079,342 to Insalaco; U.S. Pat. Reissue No. 25,136 to Carlson and U.S. Pat. No. 2,788,288 to Rheinfrank et al.

The surface to which the polyarylsiloxane is applied, may be heated to insure proper formation of the interfacial layer which is the result of interaction between the polyarylsiloxane fluid and the surface of the fuser member. Thus, the interfacial layer becomes heated and remains as a barrier layer upon the surface of the fuser member. Generally, the unreacted or virgin release fluid as it is applied to the fuser member, is heated to the temperature of the fuser roll, however, the release fluid may be somewhat cooler than the roll during operation of the device when heat transfer takes place, that is, when heat is transferred from the fuser member to the substrate containing toner undergoing the fusing process. The temperature may be adjusted by one skilled in the art in accordance with the particular type of toner, in accordance with the speed of the apparatus, and in accordance wih any other parameters which are known to one skilled in the art.

The release properties of the polyarylsiloxane fluids, are related to the splitting of the image when the toner is softened and becomes sufficiently sticky to adhere to the surface of the fuser roll which results in a partial or ghost image on the next sheet, producing what is referred to as an offset image. Therefore, the release property of the particular polyarylsiloxane fluid is a function of the offset image, and the higher the temperature of the fuser member before hot offsetting occurs, the better the release properties of the particular fluid. Furthermore, the fusing latitude, that is, the temperature at which the toner begins to fuse up to the temperature at which hot offset occurs, is also a function of the release properties of the particular polyarylsiloxane fluid. This fusing latitude, that is, the temperature range at which the fusing member can operate and including the temperature from which the toner begins to fuse up to the temperature where hot offset begins to occur, is also known as the fusing window of the fuser member. The fusing latitude is substantially improved over conventional art agents and polymeric coatings when the polyarylsiloxane fluids are applied to the fuser member.

Exemplary of fusing the toner material to the substrate is a fuser assembly which comprises a heated roll structure including a hollow cylinder or core having a suitable heating element disposed in the hollow portion thereof which is coextensive with the cylinder. The heating element may comprise any suitable type of heater for elevating the surface temperature of the cylinder to operational temperatures which are generally from 250°–400° F (121°–205° C), and for example, may be a quartz lamp. The cylinder must be fabricated from any suitable material capable of accomplishing the objects of the invention, that is, a material which not only will transfer heat to the surface to provide the temperature required for fusing the toner particles, but also a material having a surface which is capable of interacting with the polyarylsiloxane release agent to form a product which becomes an interfacial layer or barrier layer to toner intermediate the release layer and the surface of the bare fuser member to prevent toner particles from contacting the fuser surface.

Typical fuser member materials are anodized aluminum and alloys thereof, steel, stainless steel, nickel, and alloys thereof, nickel plated copper, copper, glass, zinc, cadmium, and the like and various combinations of the above. The cylinder may be fabricated from any suitable material which is capable of interacting with the polyarylsiloxane release fluid. Surface temperature of the fuser member may be controlled by means known to those skilled in the art, for example, by means described in U.S. Pat. No. 3,327,096.

In general, the fuser assembly further comprises a backup member, such as a roll or belt structure which cooperates with the fuser roll structure to form a nip through which a copy paper or substrate passes such that toner images thereon contact the fuser roll structure. The backup member may comprise any suitable construction, for example, a steel cylinder on a rigid steel core having an elastomeric layer thereon, or it may be a suitable belt material which provides the necessary contact between the fuser member and the substrate carrying the developed latent image. The dimensions of the fuser member and backup member may be determined by one skilled in the art and generally are dictated by the requirements of the particular copying apparatus wherein the fuser assembly is employed, the dimension being dependent upon the process speed and other parameters of the machines. Means may also be provided for applying a loading force in a conventional manner to the fuser assembly to create nip pressures on the order of about 15 to 150 psi average.

The fuser member treated by the method of the present invention wherein at least one polyarlysiloxane fluid is applied to a fuser member surface, said fluid being capable of interacting with the fuser member surface to form a thermally stable interfacial layer and being applied in an amount sufficient to cover the surface with at least a continuous, low surface energy film of the fluid to prevent the toner from contacting the surface of the fuser member and to provide a surface which releases the toner heated by the fuser member, is illustrated in the fuser assembly shown in FIG. 1. In FIG. 1, the numeral 1 designates a fuser assembly comprising heated roll structure 2, backup roll 8 and sump 20. Heated roll 2 includes a hollow cylinder 4 having a suitable heating element 6 disposed in a portion thereof which is coextensive with the cylinder.

Backup roll 8 cooperates with roll structure or hollow substrate 2 to form a nip 10 through which a copy paper or other substrate 12 passes such that toner images 14 thereon contact heated roll 2. As shown in FIG. 1, the backup roll 8 has a rigid steel core 16 with an elastomer surface or layer 18 thereon.

Cylinder 4 being fabricated of metal such as anodized aluminum, aluminum and alloys thereon, steel, nickel and alloys thereof, copper, and the like as described above or glass, has a surface made of relatively high surface energy materials, and consequently toner material 14 contacting such surfaces when they are heated, would readily wet the surface. Accordingly, there is provided in accordance with the embodiment of FIG. 1, sump 20 for containing at least one of the designated polyarylsiloxane release agents 22 capable of displacing heat fusible electroscopic toner when the agent is in a fluid state, said release agent being capable of interacting with the fuser member surface to form a thermally stable interfacial layer thereon when in the fluid state. The release material 22 may be a solid or liquid at room temperature, but it must be a fluid at operating temperatures preferably having a relatively low viscosity at the operating temperatures of heated roll 2.

In the embodiment shown in FIG. 1 for applying release material 22 to the surface of heated roll 2, a metering blade 24 preferably of conventional non-swelling rubber is mounted to sump 20 by conventional means such that an edge 26 thereof contacts the solid substrate 2 of the fuser roll structure to serve as a metering means for applying release material 22 to the fuser roll in its liquid or fluid state. By using such a metering blade, a layer of release fluid 22 can be applied to the surface of heated roll 2 in controlled thicknesses ranging from submicron thicknesses to thicknesses of several microns of the release fluid. Thus, by metering device 24, about 0.1 to 0.5 micron or greater thicknesses of release fluid can be applied to substrate 2. In the embodiment shown, a pair of end seals 28, for example, of sponge rubber, are provided to contain the release material 22 in sump 20. One or more stripper fingers 30 may be provided for insuring removal of the substrate 12 from substrate 2. In one of the preferred embodiments, thermoplastic resin toner is fused to paper, however, thermoplastic resin toner may be fused to other substrates such as polymeric films, metals and other substrates by the fuser members and process of the present invention, the only limitation being that the polyarylsiloxane fluids must not adversely react with the substrate upon which the toner is used and must not destroy or alter the coloring properties of the toner.

The embodiment described above in FIG. 1 is merely one of the preferred means for applying a layer of polyarylsiloxane release material capable of interacting with the fuser member surface to form a thermally stable interfacial barrier layer in an amount sufficient to cover the surface with at least a continuous, low surface energy film of the fluid to provide the fuser member with a surface which releases toner heated by the fuser member. Other means for applying the release fluid which is abhesive to heat fusible electroscopic toner at elevated temperatures comprise means which spray a layer of the release fluid upon the fuser surface, a pad or sponge-like material which pads a coating of the release fluid on the surface of the fuser member, a wick which contacts the surface of the fuser member to provide a film or layer of the release material, extruding means which extrude a minute film of the release material on the fuser member, a brush having fibers or bristles comprised of the release material or a brush or bristle having the release fluid on the surfaces of the bristles or brush materials, fluid soaked rolls, sponges or wicks and the like.

Figure 2:
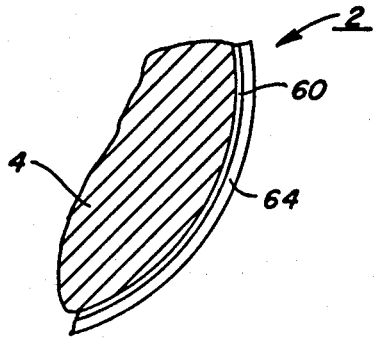
FIG. 2 is a fragmentary view of a typical fuser member of the present invention.

The fuser member for an electrostatic reproducing apparatus resulting from the method of treating the surface of a heated fuser member with at least one polyarylsiloxane fluid capable of displacing electroscopic toner, is shown in FIG. 2. The fuser member shown in FIG. 2 is magnified many times over the member shown in FIG. 1 in order to show the thin layers on the fuser member surface. In FIG. 2, the solid portion of the heated roll is designated by numeral 4. A release layer of fluid is designated by numeral 64 and an interfacial layer is designated by numeral 60. Thus, there is described a fuser member having a solid substrate 4, a release layer of polyarylsiloxane fluid, 64, which is abhesive to electroscopic toner and which interacts with the solid substrate 4, and interfacial layer 60 which prevents the electroscopic toner (not shown) from contacting solid substrate 4, said interfacial layer 60 being formed by the interaction of solid substrate 4 and the polyarylsiloxane fluid release layer 64.

In one of the preferred embodiments, solid substrate 4 of FIG. 2 comprises a metal capable of forming oxides, and in more preferred embodiments, the solid substrate 4 may be selected from the group consisting of iron, copper, aluminum, titanium, zinc, silver, nickel and cadmium and oxide-forming alloys thereof. Solid substrate 4 may also be comprised of glass and other oxide media.

In accordance with the present invention, it has been unexpectedly observed that when solid substrate 4 in FIG. 2 is an oxide-containing or -forming material and the release agent 64 is the designated polyarylsiloxane fluid, and electroscopic toner is applied thereto and softened, the electroscopic toner is displaced from solid substrate 4 by the action of fluid 64 applied thereto when release layer 64 and interfacial layer 60 are interrupted, and the surface of the substrate 4 is exposed to the toner. Interruptions in the release layer 64 and interfacial layer 60 may occur, for example, by scraping the surface by the stripper finger, by a thermistor device to control the temperature at the surface, by other abrasive forces which scratch or deface the layers coated on solid substrate 4, and the like. Thus, when electroscopic toner is applied to the surface which has been interrupted by such forces, it was unexpectedly found that the electroscopic toner is displaced from the solid substrate 4 by the action of the release layer material as it is applied to the fuser member. Although the details of this mechanism are not completely understood, it is believed that the polyarylsiloxane release fluids actually compete with the electroscopic toner for the surface of substrate 4, and because the release material is more reactive toward the solid substrate surface 4 than is the electroscopic toner, the release material actually displaces the electroscopic toner from substrate 4 as it reforms interfacial layer 60 in the interrupted zone or portion of the surface by the interaction of the release material 64 and the surface 4. Thus, by using conventional electroscopic toners, the release layer fluids are actually found to displace the electroscopic toner applied to and softened upon the surface of the fuser roll from any interruptions occurring therein, thereby preventing offsetting of the material and ghosting of the image.

A preferred apparatus and method for contact fusing of toner particles to substrate are provided by using a heated structure having a rigid core, the surface of which has a high surface energy material, e.g., metals and glasses. The core may be heated internally or externally. The core is coated with a coating of a polyarylsiloxane release material, the polyarylsiloxane being the type which is capable of some type of reaction (interaction) with the core surface material. The coating on the core surface comprises a first barrier coating portion in contact with the core surface, this first portion being formed during operation of the apparatus at the interface of the core surface and the polyarylsiloxane release material. The first portion has a greater affinity for the core surface material than the toner particles and thereby prevents toner particles from contacting the core. A second replenishing release portion is the release material itself, the polyarylsiloxane which has a cohesive force which is less than the adhesive forces between the toner particles and the substrate and the cohesive forces of the toner particles. A backup member is provided to cooperate with the heated structure to form a nip through which the substrate having toner particles thereon passes with the toner particles contacting the heated structure.

The following examples further define and describe exemplary materials for treating the surfaces of heated fuser members in an electrostatic reproducing apparatus with a polyarylsiloxane fluid capable of displacing electroscopic toner, the fluid being capable of interaction with the fuser member surface to form a thermally stable interfacial layer thereon. Parts and percentages are by weight unless otherwise indicated. The examples are also intended to illustrate the various preferred embodiments of the present invention.

EXAMPLE I

In determining the effectiveness of the polyarylsiloxane fluids, flat plate toner-release testing (static) was conducted upon a steel surface at 395° F (202° C). A heat fusible toner comprising carbon black pigmented copolymer, styrene-n-butylmethacrylate, (Xerox Corp. 364 Toner), was used to test release of the tacified toner from the steel surface. Phenyl silicone fluids (phenyl polydimethyl siloxane) provided by Dow Corning Corporation under the trade designation DC510 and have respective viscosities of 50, 100 and 1000 centistokes at 25° C, were metered onto the heated plates. These fluids demonstrated excellent release of the described toner material when applied to the metal surface on a paper substrate.

EXAMPLE II

The toner of Example I was fused on both an aluminum and a steel plate coated with polydimethyl siloxane fluid (silicone oil). Immediate release failure was observed in both cases at 202° C (395° F).

EXAMPLE III

In determining the effectiveness of the polyarylsiloxane fluids an electrostatic latent image is formed on a conventional recording surface in a conventional electrostatic reproducing apparatus, and the electrostatic latent image is developed with a heat fusible toner comprising carbon black pigmented copolymer, styrene-n-butylmethacrylate (Xerox Corporation 364 Toner), the toner particles being held on the recording surface in conformance with the electrostatic latent image. The toner image is thereafter transferred to plain paper. The paper having the toner images electrostatically adhered thereto, is then passed at a speed of about 15 inches per second between a fuser roll structure and a backup roll, the fuser roll structure being the type wherein temperature can be controlled as well as nip pressure. The toner image contacts a fuser roll structure which has a 2.0 inch outside diameter and is 4 inches long. The backup roll has an outside diameter of about 2.0 inches with a 0.1 inch layer of silicone rubber covered with a 0.020 inch coating of fluorinated ethylenepropylene resin on the surface and having a durometer of 65 Shore A. The fuser roll is fabricated from steel. Phenyl polydimethyl siloxane fluid provided by Dow Corning Corporation under the trade designation DC510 and having respective viscosities of 50, 100 and 1000 centistokes at 25° C is metered onto the fuser roll by means of a doctor blade prior to contacting thereof by the toner image. Fuser latitude or fusing window is then determined. The fusing range at which release of toner occurs begins at about 225° F (107° C) and extends to about 400° F (204° C). This is an advantage of nearly 200° F (nearly 100° C) and corresponds to a large increase in fusing component life and machine copy per minute speed. The fusing range remains about the same for the fluids having viscosities of 50, 100 and 1000 centistokes at 25° C respectively.

In accordance with the stated objects there has been demonstrated a release agent, a fusing process and a fusing member for fixing toner images. In the above experiments with the release agents, toner is actually displaced from exposed surfaces of fuser members having the polyarylsiloxane fluids with at least one aryl or aryl substituted per polymer molecule coated upon the surface, by reason of the action of the release agent. Where the surface areas are gouged so that toner material becomes lodged upon the steel surface, the toner material is actively displaced from the surface of fuser members by the action of the release agent, and toner contamination of subsequent copies is avoided. It has been demonstrated that fuster members need no longer be coated with solid fluoropolymers, gums or elastomers in addition to various oils and fluids to promote release of toner comprising resinous components from fuser members.

While the invention has been described with respect to preferred embodiments, it will be apparent that certain modifications and changes can be made without departing from the spirit and scope of the invention, and therefore, it is intended that the foregoing disclosure be limited only by the claims appended hereto.

What is claimed is:

1. The method of fusing electroscopic toner images to a substrate including the steps of:

a. forming a film on a heated metal fuser member in an electrostatic reproducing apparatus, said film being a barrier to electroscopic toner and comprising the product resulting from the interaction of the fuser member and a polyarylsiloxane having at least about 0.5 aryl group or substituted aryl group per molecule which interacts with the fuser member surface, said polyarylsiloxane being fluid at the temperature of the fuser member and acting as a release fluid film for the electroscopic toner;

b. contacting the toner images on said substrate with the coated, heated fuser member for a period of time sufficient to soften the electroscopic toner; and c. allowing the toner to cool.

2. The method of claim 1 comprising continuously depositing the polyarylsiloxane on the heated fuser member to maintain a toner barrier coating and fluid toner release film of at least about 0.5 micron in thickness.

3. The method of claim 2 wherein the thickness of the film is maintained at about 1 to about 4 microns.

4. The method of claim 1 comprising fusing the electroscopic toner to paper.

5. The method of claim 1 comprising contacting the heated fuser member with said polyarylsiloxane which is a solid or liquid at ambient temperature and a liquid at operating temperature.

6. The method of claim 1 comprising applying said polyarylsiloxane to a fuser member having a copper surface.

7. The method of claim 1 comprising applying said polyarylsiloxane to a fuser member having a steel surface.

8. The method of claim 1 comprising applying said polyarylsiloxane to a fuser member having an aluminum surface.

9. A method of fusing toner images to a substrate including the steps of:

a. coating the surface of a heated metal fuser member in an electrostatic reproducing apparatus with a polyarylsiloxane release material, said polyarylsiloxane release material being the type capable of interacting with the surface of the fuser member, said coating comprising a first barrier portion in contact with the surface of the fuser member, said first portion being formed during operation of the apparatus at the interface of the fuser member and the polyarylsiloxane release material, the first portion having a greater affinity for the high surface energy material of the fuser member surface than the toner and thereby preventing toner from contacting the fuser member surface, and a second release portion, the release portion being the fluid polyarylsiloxane release material having a cohesive force which is less than the adhesive forces between the toner and the substrate and the cohesive forces of the toner;

b. contacting the toner images on said substrate for a period of time sufficient to soften the toner; and c. allowing the toner to cool.

10. The method of claim 9 wherein the polyarylsiloxane release material is a solid or liquid at room temperature and a fluid at operating temperatures.

11. The method of claim 9 wherein the thickness of the polyarylsiloxane release material on the surface of the heated fuser member is sufficiently thin to constitute a minimal barrier to heat transfer.

12. The method of claim 11 wherein the thickness of the polyarylsiloxane release material on the fuser member is about 0.5 to about 10 microns.

13. The method of claim 9 comprising continuously applying the polyarylsiloxane release material to the surface of the fuser member to maintain thereon the second release portion of the fluid and the first barrier portion.

14. The method of claim 9 wherein polyarylsiloxane release material has at least about 0.5 aryl groups, substituted aryl groups or a combination of said groups per siloxane molecule.

15. The method of claim 9 wherein the polyarylsiloxane release material comprises polyarylmethyl dimethylsiloxane having from about 0.5 methyl group per single polymer chain or from about 1.0 group per two polymer chains substituted by aryl or aryl substituted groups.

16. The method of claim 9 wherein the polyarylsiloxane release material is polyphenylmethyl dimethylsiloxane.

17. The method of claim 9 wherein the polyarylsiloxane release material is polychlorophenylmethyl dimethylsiloxane.

18. The method of claim 9 wherein the polyarylsiloxane release material is polybromophenyl dimethylsiloxane.

19. The method of claim 9 wherein the polyarylsiloxane release material is polyiodophenyl dimethylsiloxane.

20. The method of claim 9 wherein the polyarylsiloxane release material is polyiodonaphthyl dimethylsiloxane.

* * * * *